United States Patent [19]

Rankin

[11] 4,229,864

[45] Oct. 28, 1980

[54] YARN HOLDER AND DISPENSER FOR MAKING HOOKED RUGS

[76] Inventor: Georgia A. Rankin, Highway 42-57, Sturgeon Bay, Wis. 54235

[21] Appl. No.: 27,172

[22] Filed: Apr. 4, 1979

[51] Int. Cl.[3] ..... D03D 7/00; D03G 3/02

[52] U.S. Cl. ..... 28/147; 28/149

[58] Field of Search ..... 28/147, 149, 159; 289/18; 139/1 R

[56] References Cited

U.S. PATENT DOCUMENTS

| | | | |
|---|---|---|---|
| 2,150,024 | 3/1939 | Clack | 28/149 |
| 2,202,924 | 6/1940 | Rosen | 28/149 |
| 3,621,541 | 11/1971 | Watkins | 28/149 |
| 3,970,338 | 7/1976 | Crowe | 28/147 |

FOREIGN PATENT DOCUMENTS

| | | | |
|---|---|---|---|
| 23720 | of 1909 | United Kingdom | 28/147 |

*Primary Examiner*—Henry Jaudon

*Attorney, Agent, or Firm*—Ralph G. Hohenfeldt

[57] ABSTRACT

A holder for forming loops in short strands of yarn to facilitate picking them up with a latch hook in connection with making a hooked rug comprises a sheet of plastic divided into sections by crease lines that serve as hinges to enable some sections to be folded over others. A median section has a slot over which the middle portions of a group of parallel arranged short yarn strands are laid. A section on one side of the slot serves as an ejector blade which folds over the median section and other sections subsequently fold over the blade section. The blade section is then advanced and retracted to force the yarn through the slots to expose the loops for access. The holder finally folds into a triangular configuration which may be placed on a table or held in one hand during use.

9 Claims, 7 Drawing Figures

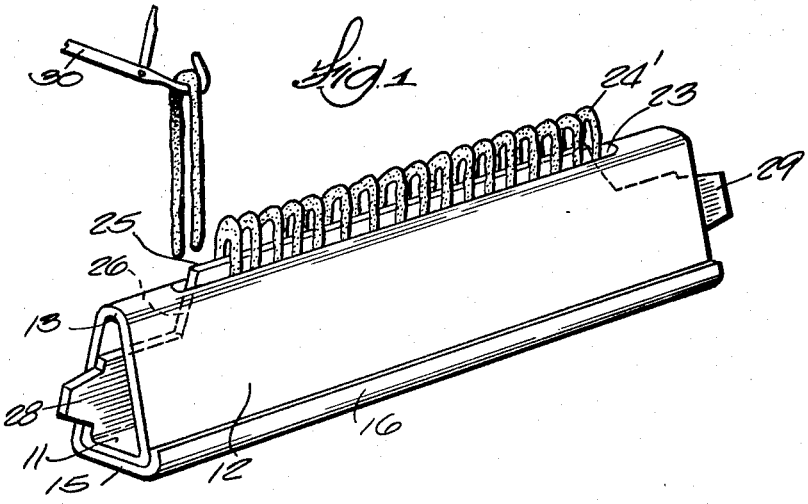
Fig. 1
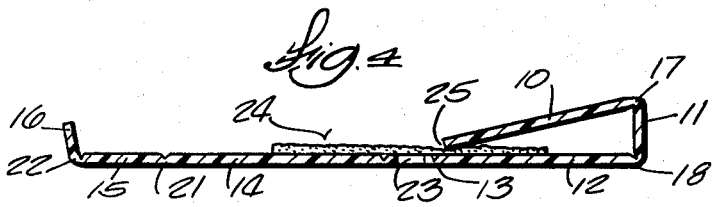
Fig. 4
Fig. 2.
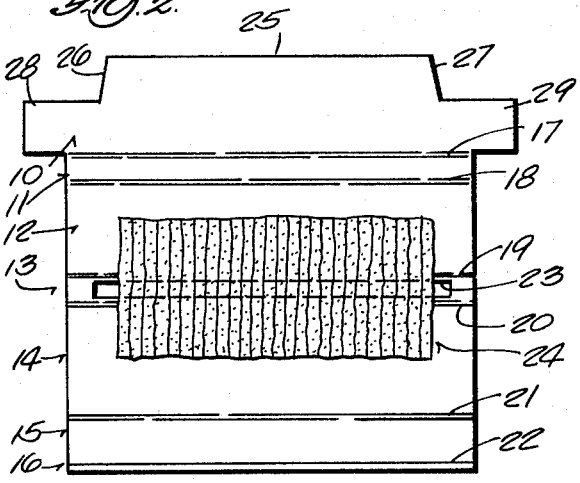
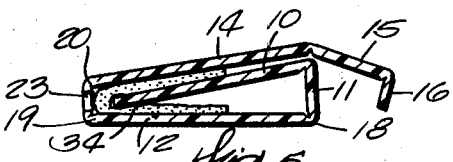
Fig. 5
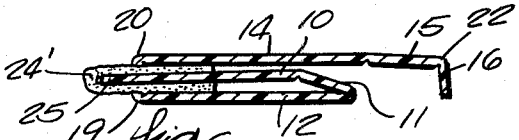
Fig. 6
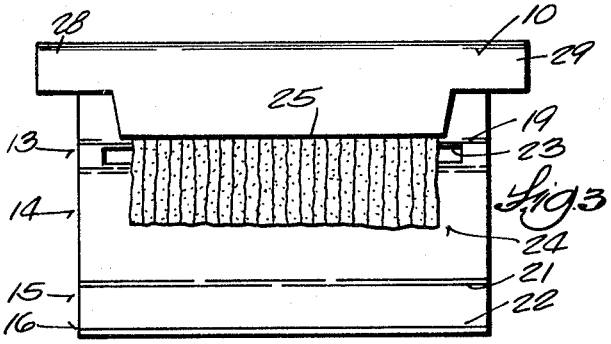
Fig. 3
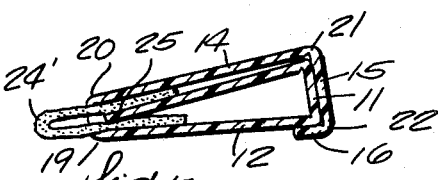
Fig. 7

YARN HOLDER AND DISPENSER FOR MAKING HOOKED RUGS

This invention relates to a device for forming short strands of yarn into loops for facilitating picking the strands up with a latch hook incidental to making hooked rugs.

In making hooked rugs, the operator uses short lengths of yarn which are picked up by a latch hook and tied to an open meshed canvas backing material. The yarn strands are usually quite short, that is, about two inches in length and are difficult to handle.

SUMMARY OF THE INVENTION

An object of the present invention is to provide a device which can form a large number of short lengths of yarn with median bends or loops which are all presented for easy engagement one at a time, with a latch hook.

In accordance with a preferred embodiment of the invention, the new yarn holder comprises a plastic sheet that is divided into planar sections by transverse parallel creases which act as hinges. A main section has a transverse slot in it. Several short lengths of yarn are arranged in parallelism and laid across the slot with their midpoints coincident with the slot. One end section of the sheet constitutes an ejector blade which, when properly folded over, presses all of the yarn strands at their midpoints and holds them at a place near the slot. Sections on the other side of the blade section are then folded over it and the blade section is rocked into the slot to force the strands through it and form them into loops which project from the slot for singular access with a latch hook.

An illustrative embodiment of the invention will now be described in detail in reference to the drawing.

DESCRIPTION OF THE DRAWING

FIG. 1 is a perspective view of the new yarn holder ready for use;

FIG. 2 is a plan view of the holder which has been loaded with a group of short yarn lengths and is ready to be folded into the configuration in which it appears in FIG. 1;

FIG. 3 is a plan view showing the holder after it has undergone the first folding step;

FIGS. 4–7 are sectional views of the holder corresponding, respectively, with the sequence of folding steps which culminate in the final assembly shown in FIGS. 7 and 1.

DESCRIPTION OF A PREFERRED EMBODIMENT

FIG. 2 shows the holder in its initial unfolded condition. It comprises a planar sheet of plastic material such as polyvinyl although other plastics and semi-rigid material such as cardboard could be used. The planar sheet is partitioned into flat sections marked 10–16. The sections are separated by scoring or crease lines that serve as hinges on which the sections may be folded relative to each other to form the triangular shaped holder shown in FIG. 1. For example, there is a hinge line or crease 17 separating what is called the ejector blade section 10 or first end section and the next adjacent planar section 11. Another hinge line 18 separates intermediate planar sections 11 and 12. A hinge line 19 separates sections 12 and 13; a hinge line 20 separates sections 13 and 14; a hinge line 21 separates section 14 from base section 15; and, a hinge line 22 separates base section 15 and a locking flap or tongue section 16. If a suitable plastic is used, the hinge lines may be formed by pressing a hot blade into the material to reduce its thickness and form a groove for facilitating folding the sections relative to each other. The device could also be made by stamping out the sections individually and hinging them together with a flexible tape, not shown. By way of example and not limitation, the width of the sections is desirably about six inches in one model.

In FIG. 2 one may see that the narrow middle section 13 has a transverse slot 23. An array of short yarn strands 24, such as are used for making hooked rugs and are to be formed into loops with the holder, are laid across the slot 23 in parallelism with each other and with their midpoints substantially coincident with the slot. Placing the group of yarn strands 24 in this manner is the first step which precedes a sequence of section folding steps which result in the device arriving at the triangular configuration in which it appears in FIG. 1. Typically, thirty to fifty yarn strands will be placed over the slot.

Note in FIG. 2 that the first or top end section 10 is shaped to act as a yarn ejector blade. For this purpose, the outer edge 25 of ejector blade section 10 has a length which is slightly shorter than the length of slot 23 in section 13. At the ends of edge 25, the ejector blade is beveled as at 26 and 27 and these beveled ends extend to a pair of tabs 28 and 29 which are integral with section 10.

FIG. 3 shows the yarn holder of FIG. 2 after the first folding step has been taken in the sequence of folding steps which will result in the final assembly that is depicted in FIG. 1. In FIG. 3, blade section 10 and adjacent section 11 are folded on their hinge lines 17 and 18 so as to dispose ejector blade edge 25 adjacent transverse slot 20 in narrow central section 13. By pressing down on blade section 10, the group of short yarn lengths 24 become seized.

FIG. 4 shows the profile of the yarn holder in the stage of the section folding sequence in which it is depicted in FIG. 3. Thus, in FIG. 4, one may see that the leading edge 25 of ejector blade section 10 is at the edge of transverse slot 23 and that the group of short yarn lengths 24 are pressed against planar section 12. The placement of the yarn lengths on the holder and the folding sequence beginning with the step depicted in FIG. 4 is desirably done while the device is resting on a flat surface such as on a table top.

The next step in the folding sequence is depicted in FIG. 5. Here planar section 14 has been folded back over blade section 10 to bend the yarn strands 34 into loops with ejector blade edge 25 at their midpoints.

The next step is shown in FIG. 6. Here the assembly has been rocked on hinge lines or creases 17 and 18 to project the leading edge 25 of the ejector blade 10 through the slot 23 to thereby form loops 24' in all of the yarn lengths and these loops are now all exposed on the outside of the device and they are still in substantial parallelism with each other. The blade may be rocked to project its leading edge by simply pressing down on section 14.

The last state of the section folding is depicted in FIG. 7. Here section 15 has been folded over intermediate section 11 and the short end flap section 16 has been bent around to serve as a lock which prevents inadvertent unfolding of the yarn holder.

Section 15, as can be seen in the final assembly shown in FIG. 1, may serve as a base for the triangularly shaped holder which is shown standing upright and constrained to remain in folded condition by letting blade edge 25 extend partially into slot 23. The slot 23 is now at the top of the triangle whose apex is, in a sense, truncated by slotted section 13. All of the yarn loops 24' are projected upwardly and are isolated from each other so that they may be easily engaged, one by one, with a conventional latch hook 30 for insertion with the latch hook into the canvas mesh, not shown, which serves as a base for a hooked rug. An advantageous technique for using the holder is to hold it in one hand and hold the latch hook in the other hand to facilitate picking off one yarn strand at a time. This also assures that the holder will not unfold inadvertently. If the user has a tendency to squeeze the holder quite hard, the beveled edges 26 and 27 of ejector blade 10 will simply wedge at the ends of slot 23 and prevent collapsing of the holder. The yarn strands can still be withdrawn under this circumstance.

When the user desires to reload the holder with a new group of short yarn lengths, tabs 28 and 29 on the ejector blade are manually engaged for forcing the blade edge 25 to retract from slot 23 after which the holder may be unfolded and restored to its flattened FIG. 2 condition for enabling another array of yarn strands to be deposited across the slot.

Although a preferred embodiment of the new slotted yarn holder has been described in considerable detail, such description is intended to be illustrative rather than limiting, for the holder may be variously embodied and is to be limited only by construing the claims which follow.

I claim:

1. A yarn holder comprising:

a generally planar section having a slot across which yarn may be placed, an ejector blade section hinged to said planar section and having an edge portion that is sized for passing into said slot such that when said blade section is folded on its hinge over said planar section and advanced through said slot from one of its sides a loop will be formed in said yarn on the other side of said slot.

2. A holder for forming and maintaining a loop in each of several yarn strands comprising:

a plurality of sections hinged to each other in succession, one of said sections having a transverse slot across which a group of yarn strands may be laid, a first section which is displaced in one direction from said slot by intermediate sections, said first section constituting a yarn ejector blade having an edge shaped for passing into said slot and said first section being foldable with an intermediate section to place said edge on the yarn strands in proximity with the slot, another section displaced from said slot in another direction opposite of said one direction being foldable over said blade section to thereby bend said yarn strands and enable said ejector blade to be rocked to advance it into said slot from one side for forming loops in the yarn which extend from the other side of the slot.

3. The yarn holder as in claim 2 wherein:

an additional section which is hinged to said other section is arranged for being folded over an intermediate section that is hinged to said blade section for said additional section to serve as a base for said holder.

4. The holder as in claim 3 wherein:

said additional section has a flap hinged to it that is foldable to serve as a means for retaining said holder in folded condition.

5. The holder as in any of claims 1, 2, 3 or 4 wherein said sections are formed from a unitary sheet of material in which there are creases constituting the hinge connections between sections.

6. The holder as in any of claims 1, 2, 3 or 4 wherein said sections are composed of a material selected from the class consisting of paper and plastic.

7. A yarn holder for use in connection with making hooked rugs, comprising:

a succession of planar sections including a first end section for serving as a yarn ejector blade and a second opposite end section for serving as a base and other sections intermediate of said first and second sections, each section being hingedly connected to the next adjacent section and said sections being foldable on said hinge connections to form a generally triangularly shaped holder, one of said sections intermediate said opposite end sections having a slot across which a plurality of yarn strands may be laid when said holder is unfolded, said blade section being foldable in one direction to hold said yarns at said slot and other of said sections being foldable in an opposite direction over said blade section and base section to bend said yarns and enable said blade section to be advanced into said slot from one side to form a plurality of yarn loops on the other side.

8. The holder as claimed in claim 7 wherein:

said sections are composed of a single piece of sheet material and said sections are hinged together by creases in said material between respective sections.

9. The holder as claimed in claim 7 wherein:

said blade section has manually engageable tabs accessible from the ends of said blade section when said holder is folded into triangular shape, said blade section assisting in retaining said holder in triangular shape when said blade section is in said slot and said blade section being retractable from said slot by applying force on said tabs to enable the holder to be unfolded for reloading with yarn strands.

* * * * *